US008151378B2

(12) United States Patent
Dong

(10) Patent No.: US 8,151,378 B2
(45) Date of Patent: Apr. 10, 2012

(54) PRESSURE FLUSHING DEVICE

(76) Inventor: Xiao-Qing Dong, Zhejiang (CN)

( * ) Notice: Subject to any disclaimer, the term of this patent is extended or adjusted under 35 U.S.C. 154(b) by 347 days.

(21) Appl. No.: 12/599,958

(22) PCT Filed: Jul. 17, 2008

(86) PCT No.: PCT/IB2008/001866

§ 371 (c)(1),
(2), (4) Date: Nov. 12, 2009

(87) PCT Pub. No.: WO2009/007840

PCT Pub. Date: Jan. 15, 2009

(65) Prior Publication Data

US 2010/0212078 A1 Aug. 26, 2010

(30) Foreign Application Priority Data

May 17, 2007 (CN) ..... 2007 1 0022634

(51) Int. Cl.
*E03D 1/14* (2006.01)

(52) U.S. Cl. ..... 4/325; 4/354; 4/415; 4/410

(58) Field of Classification Search ..... 4/431, 432, 4/415, 324, 325, 354
See application file for complete search history.

(56) References Cited

U.S. PATENT DOCUMENTS 4,707,868 A * 11/1987 Hennessy ..... 4/362
5,970,527 A * 10/1999 Martin et al. ..... 4/361
6,343,387 B1 * 2/2002 Beh ..... 4/415
6,453,479 B1 * 9/2002 Parsons et al. ..... 4/378
6,502,251 B1 * 1/2003 Teshima et al. ..... 4/300
6,907,623 B2 * 6/2005 Beh ..... 4/354
7,010,816 B2 * 3/2006 Li ..... 4/354
7,653,951 B2 * 2/2010 Gubeli et al. ..... 4/354
2004/0237183 A1 * 12/2004 Lindroos ..... 4/431

* cited by examiner

*Primary Examiner* — Gregory Huson
*Assistant Examiner* — Janie Christiansen

(57) ABSTRACT

This invention is a toilet flushing system. It consists of a button controlled pressure flushing device, a sealed water tank, a flushing valve, major and minor flushing control valves, an air induce device and a one-way water valve. The characteristic of the system is that the button controlled pressure flushing device has a water-volume adjustable valve, a flushing valve with a sealed cavity which has a water injection pipe and a water release pipe. The inlet and the outlet of the water-volume adjustable valve are connected to the outlet of the one-way water valve and water injection pipe of the flushing valve respectively. The inlets of the major and minor flushing control valve are connected to the water release pipe of the flushing valve. The outlets of the major and minor control valves are linked to the main release outlet which has large diameter and high speed on-off action. Compare with the existing pressure-assistant flushing system, its structure is simple and at the same times, the amount of water used in the minor flushing can be controlled by adjusting the flow difference between water-volume adjustable valve and the minor control valve.

6 Claims, 4 Drawing Sheets

PRESSURE FLUSHING DEVICE

BACKGROUND OF THE INVENTION

1. Field of the Invention

The present invention relates to a flushing device in the bathroom, particularly to a button-controlled pressure flushing device.

2. Description of the Related Art

Basically, there are three kinds of existing flushing devices, one is to hang the water tank aloft. The high hanging water tank converts a high potential energy of the water into the kinetic energy of the same to flush filthy substances in the toilet. However, afore flushing means substantially wastes the treasure water resource. An other of the flushing devices enlarges the diameter of an outlet pipe to swiftly wash out the filthy substances in the toilet. Nonetheless, the larger diameter readily results in dripping, and the treasure water is also adversely wasted. The other of the flushing devices is directed to a pressure flushing device including a sealed water tank, a flushing valve, a flushing switch, and a one-way valve. Wherein, the sealed water tank installs an inlet, the flushing valve is densely disposed on the bottom of the sealed water tank, and a running water pipe connects to the inlet of the sealed water tank via the one-way valve. As a result, when the sealed water tank is filled with water, the soaring water level would compress the air therein, so that the water becomes the high-pressure water. Since the atmospheric pressure is as same as the hydraulic pressure in the running water pipe, the soaring water level of the running water would thence provide a stored pressure, and the sealed water tank could thence store water to compress the air therein. Wherein, this flushing means with high-pressure water to provide a jet stream is generally acknowledged as the most efficient way to save water. A pressure flushing device for the squatting toilet disclosed by the CN Patent Number 200420060321.2 issued the combination of a tank body, a valve body, an air induce member, an outlet member, a flushing member, and an air-water mixture device. Wherein, this flushing device further includes a case and an anti-backflow device. In addition, the case is installed on the tank body, and a decorative cover connects to the tank body. Moreover, the anti-backflow device has a protective casing for backflow prevention, a pressure maintaining piston, a spring, and a core part. Herein, the protective casing for backflow prevention is fixed to the inlet valve body, and the core part with a ball is disposed inside the protective casing. The pressure maintaining piston provides with a pressure maintaining ball and a sealing member, which is pressed in the inlet valve body via the spring. Further, the air induce device includes an air induce core and an air induce nut; whereby, the air induce core would be mounted on the inlet valve body via the air induce nut. The outlet device consists of an inner screw shaft, an outer screw shaft, a spring, a valve needle, a spiral wall, a sleeve, and a plug. After the inner screw shaft surrounded by the spring and the sealing member penetrates through the outer screw shaft for mounting on a smaller plug; the valve needle would be thence installed in the needle base, and the needle base would be installed inside the outlet valve body. The outer screw shaft further goes through the spring and the sealing member so as to get through the sleeve and install in the plug. Moreover, the sleeve is fixed inside the valve body, and the sleeve has the sealing member disposed thereon. The flushing device includes a flush piston rod, a spring, a plug head, and a flush piston. Wherein, the flush piston rod has the spring installed on an inner side thereof, a sealing member is installed on the joint of the flush piston rod, the plug head is further disposed on the spring, and the flush piston engages with the threads on the flush piston rod. Thereby the entire flushing device would be embedded in an upper case for suiting to a weephole of a lower case. Nevertheless, the abovementioned disclosure has the disadvantages of the complicated parts and structure as well as the high cost and non-reliability. Especially, the above disclosure has to be executed with a long time. Moreover, although the hydraulic pressure is high during flushing, the flow is still not large enough for achieving an efficient flushing. In addition, the volume of water is fixed, so users are unable to adjust the volume according to the practical condition. Thus, the aforesaid means is still incapable of achieving the preferred water-saving efficiency, which is adverse to promote the product.

SUMMARY OF THE INVENTION

Therefore, the objective of the present invention is to offer a button-controlled pressure flushing device with a simple structure, which conduces to an adjustable water-volume and a favorable flushing efficiency.

The button-controlled pressure flushing device in accordance with the present invention essentially comprises a sealed water tank, a flushing valve, major and minor flushing control valves, an air induce device, and a one-way water valve. Wherein, an inlet hole is disposed under the sealed water tank, and an outlet hole is disposed at a bottom of the sealed water tank. The one-way water valve is installed on the inlet hole, and the flushing valve is densely disposed on the outlet hole. Characterized in that, the button-controlled pressure flushing device further includes a water-volume adjustable valve made by a valve with adjustable diameters. The major and minor flushing control valves are respectively configured by button-type valves in two different diameters. The flushing valve has a valve disc levelly disposed thereon, which adopts an elastic rubber material. A lower surface of the valve disc covers an opening of the valve, and a sealed cavity is formed between an upper surface of the valve disc and an inner wall of the flushing valve. The sealed cavity has a water injection pipe and a water release pipe. An inlet of the water-volume adjustable valve connects to an inlet hole of the sealed water tank, and an outlet of the same connects to the water injection pipe of the sealed cavity. Inlets of the major and minor flushing control valves concurrently connect to the water release pipe of the sealed cavity. Outlets of the major and minor flushing control valves link to an exterior of the sealed water tank via a linking pipe for communicating with the outside.

Comparatively, the structures of the major and minor flushing control valves and the flushing valve are simplified, hence resulting a convenient production and fabrication. Therefore, the cost is lessened. The most important is that the flow differences between the water-volume adjustable valve and the minor flushing switch could be adjusted to control the pressure balance points in the sealed cavity and in the sealed water tank during the flushing. Therefore, the water-volume could be preferably controlled.

The preferred embodiment together with the drawings would be carefully depicted as follows.

DETAILED DESCRIPTION OF THE PREFERRED EMBODIMENTS

Figure 1:
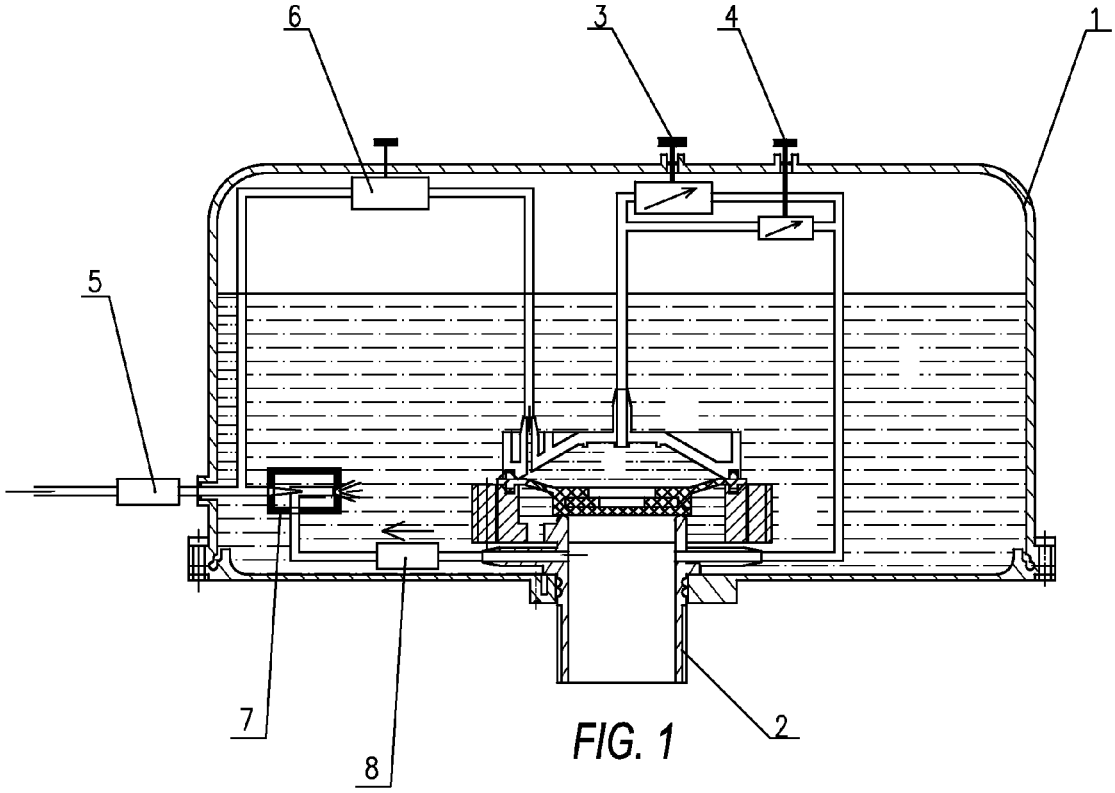
FIG. 1 is a schematic view showing a substantial embodiment of the present invention.
Figure 2:
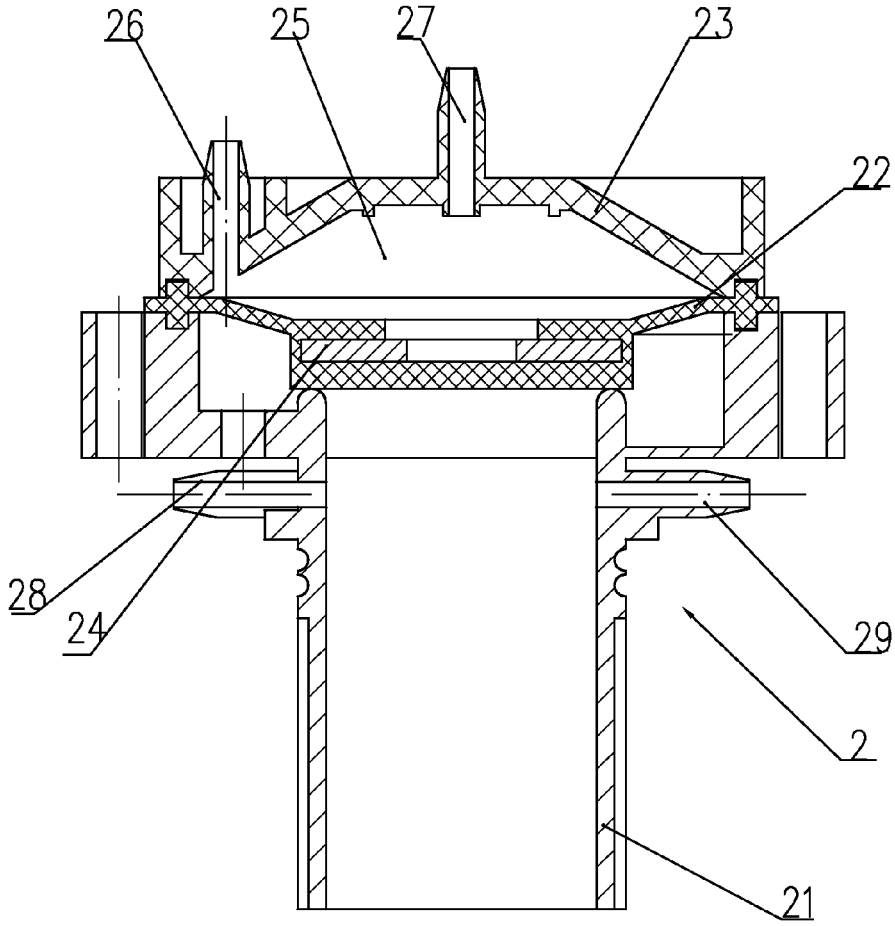
FIG. 2 is a schematic view showing a flushing valve of the present invention.
Figure 3:
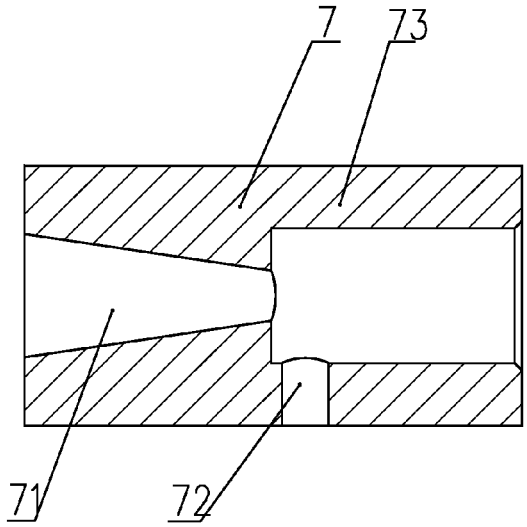
FIG. 3 is a schematic view showing an air induce device of the present invention.
Figure 4:
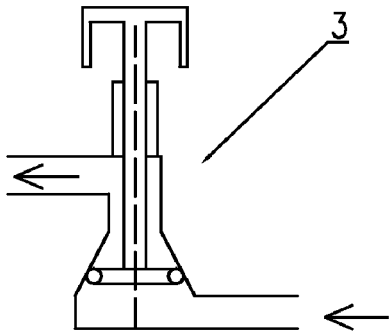
FIG. 4 is a schematic view showing a major flushing control valve of the present invention in the on-state.
Figure 5:
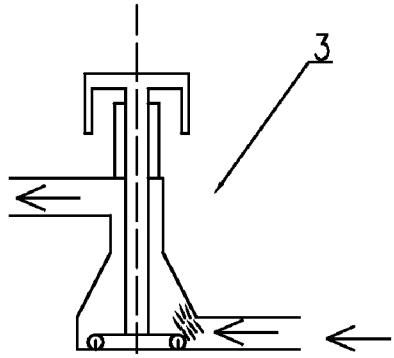
FIG. 5 is a schematic view showing the major flushing control valve of the present invention in the off-state.
Figure 6:
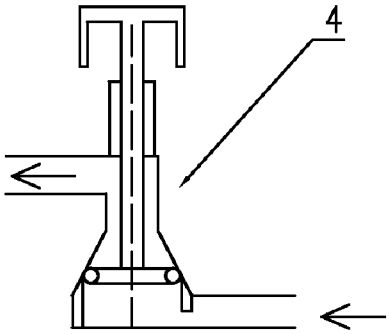
FIG. 6 is a schematic view showing a minor flushing control valve of the present invention in the on-state.
Figure 7:
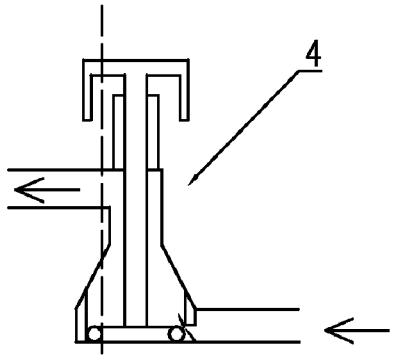
FIG. 7 is a schematic view showing the minor flushing control valve of the present invention in the off-state.
Figure 8:
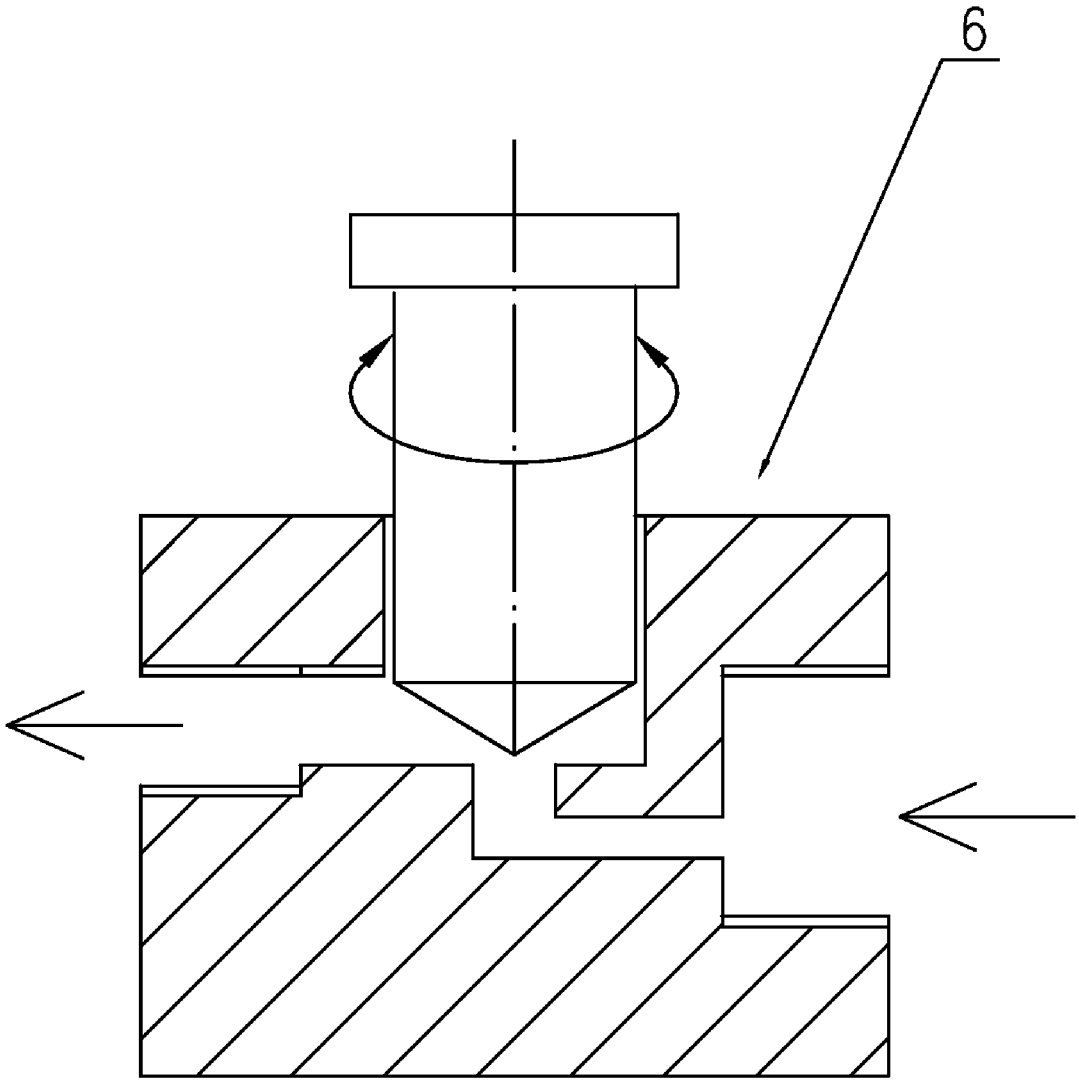
FIG. 8 is a schematic view showing a water-volume adjustable valve of the present invention.

Referring to FIG. 1 shows the present invention comprises a sealed water tank 1, a flushing valve 2, a major flushing control valve 3, a minor flushing control valve 4, a one-way water valve 5, a water-volume adjustable valve 6, and an air induce device 7. Wherein, the air induce device 7 is formed by an inlet channel 71, an outlet channel 73, and an air channel 72. Referring to FIG. 3, the inlet channel 71 forms a taper shape, and the air channel 72 connects to a convergence of the inlet channel 71 and the outlet channel 73, so that the air induce efficiency could be promoted. The one-way water valve 5 connects to the inlet channel 71 of the air induce device 7, and the air channel 72 connects to a linking pipe. A one-way air induce valve 8 connects to an air induce hole that communicates with the exterior of the sealed water tank 1. Wherein, an outlet hole is defined on the bottom of the sealed water tank 1, and the flushing valve is perpendicularly sealed on the outlet hole. Thereby, a running water pipe could fill the sealed water tank 1 with water via the air induce device 7. Referring to FIG. 2, in this embodiment, the flushing valve 2 includes a valve body 21, a valve disc 22, and an upper cover 23. The valve body 21 is formed by the circular valve disc with a plurality of linking posts connecting to a tubular member disposed thereunder. A top portion of the tubular member forms a valve opening. The channel between the linking posts and the tubular opening forms an inlet hole on the flushing valve 2. The dimension of the upper cover 23 suits to the circular valve disc base. Further, an inner wall of the upper cover 23 is inwardly formed by an arcuate shape. The valve disc 22 is made of a circular platform fabricated by the elastic rubber and provided with a thin brim formed on an upper periphery thereof. A diameter of the brim is consistent with a diameter of the valve base; a diameter of the circular platform is larger than that of the valve opening. The circular platform further provides with a rigid ring 24 or a rigid circle plate embedded therein. By this manner, the functions of dense sealing and agile opening could be concurrently accomplished. Sequentially, the valve disc 22 is installed on the circular valve disc base, and a lower surface of the valve disc 22 covers the valve opening. The upper cover 23 further presses the circular valve disc base for clipping the valve disc 22 there between, so that a sealed space as a sealed cavity 25 is accordingly formed between the upper surface of the valve disc 22 and the inner wall of the upper cover 23. The upper surface of the upper cover 23 has two tubular joints, the water injection pipe 26 and the water release pipe 27, intercommunicated with an inner hole. Two respective tubular joints, the air induce hole 28 and the water release hole 29, applying to link with the inner hole are disposed on a tubular wall of the valve body 21 of the flushing valve 2 for being intercommunicated with the exterior. The air channel 72 of the air induce device 7 communicates with exterior via the connection of the one-way air induce valve and the air induce hole 28. Referring to FIG. 8, the water-volume adjustable valve 6 is formed by a type of valve whose diameter is adjustable. Wherein, the inlet of the water-volume adjustable valve 6 connects to the outlet of the one-way water valve 5, and the outlet further connects to the water injection pipe 26 of the sealed cavity 25. As shown in FIGS. 4 to 7, the major and minor flushing control valves 3, 4 are respectively structured by button-type valves in two different diameters. Herein, the major flushing control valve 3 involves a larger diameter; the minor flushing control valve 4 involves a smaller diameter. Moreover, the inlets of the major and minor flushing control valves 3, 4 concurrently connect to the water release pipe 27 of the sealed cavity 25; whereas, the outlets of the same connect to the water release hole 29 via the linking pipes.

The present invention utilizes the following operation: when the running water (>1.8 kg/cm$^2$) passes through the one-way water valve 5 and the air induce device 7 base on the principle that a negative pressure would be generated to facilitate the introduction of air while jetting the pressure water, the sealed water tank 1 would be filled with air and water. Therefore, the pressure energy provided by the jetted water and air would compress the sealed water tank 1. Accordingly, when the generated hydraulic pressure of the water equals to the pressure in the cavity, the running water would stop offering, and part of pressed air could be still maintained in the sealed water tank 1. In time of feeding the running water, the sealed cavity 25 of the flushing valve 2 would be filled with water until the pressures from the running water and the sealed cavity 25 and the water pressure as well as partial air pressure in the sealed water tank 1 all arrive the same. Thus, a balance of the pressures of aforesaid elements could be accomplished.

Since the pressure from the sealed cavity 25 to the valve disc 22 is larger than the counter pressure from the sealed water tank 1 to the valve disc 22, subjected to the same pressure value but in different bearing areas, the valve disc 22 would tightly seal the valve opening. The flushing valve 2 would thence be shut, and the water in the sealed water tank 1 would keep a ready-to-jet state.

When the major flushing control valve 3 is pressed to turn on the device, the water in the sealed cavity 25 would be swiftly discharged via linking pipes in a short time. At this time, the water guided from the water-volume adjustable valve 6 fails to sufficiently fill the sealed cavity 25, which makes the hydraulic pressure in the sealed cavity 25 rapidly decline toward the atmospheric pressure. Concurrently, the hydraulic pressure in the sealed water tank 1 would prop the valve disc 22 of the flushing valve 2 up, and then the ready-to-jet water in the sealed water tank 1 would be discharged speedily via the assistance of pressure. Consequently, after the swift discharge of the water in the sealed water tank 1, the pressure in the sealed water tank 1 becomes the atmospheric pressure in a short time. Thereafter, the running water would fill the sealed water tank 1 again for a next complete flushing process.

When the minor flushing control valve 4 is pressed to turn on the device, the water in the sealed cavity 25 would be slightly discharged via the pipes. Wherein, the water flowing from the water-volume adjustable valve 6 into the sealed cavity 25 and the water discharged due to the opening of the minor flushing control valve 4 would achieve a new balance. Therefore, the hydraulic pressure in the sealed cavity 25 would maintain its pressure between the atmospheric pressure and the static pressure of the running water. Correspondingly, when the valve disc 22 is raised, the ready-to-jet water in the sealed water tank 1 would be discharged under the pressure force. After the water in the sealed water tank 1 is discharged, part of the pressure in the sealed water tank 1 would increase to the pressure equal to that of the sealed cavity 22, so that the valve disc 22 would be repositioned to the shut state for stopping discharge, hence attaining a minimum discharge. Importantly, the amount of the lower volume of discharge is mainly controlled by the water-volume adjustable valve 6. That is to say, in case of the minor flushing control valve 4 being pressed for an opening, the larger the water-volume adjustable valve 6 are opened, the faster the water are introduced into the sealed cavity 25, and thence the less water are discharged from the sealed water tank 1 under the pressure.

I claim:

1. A button controlled pressure flushing device comprising a sealed water tank, a flushing valve, a major flushing control valve, a minor flushing control valve, an air induce device, and a one-way water valve; said air induce device including an inlet channel, an outlet channel, and an air channel that intercommunicate with each other; said one-way water valve connecting to said inlet channel of said air induce device; said air channel connecting to an air induce hole via a linking pipe; said air induce hole communicating with an exterior of said sealed water tank; an outlet hole being disposed at a bottom of said sealed water tank; said flushing valve being densely installed on said outlet hole; a running water pipe serving to fill said sealed water tank being with water via said air induce device; characterized in that, said button-controlled pressure flushing device further including a water-volume adjustable valve that has a valve with adjustable means; said major and said minor flushing control valves being respectively structured by button-type valves made of two different diameters; a valve disc of said flushing valve adopting an elastic rubber material; a lower surface of said valve disc covering an opening of said valve, and a sealed cavity being formed between an upper surface of said valve disc and an inner wall of said flushing valve; said sealed cavity having a water injection pipe and a water release pipe; an inlet of said water-volume adjustable valve connecting to an outlet of said one-way water valve; said outlet further connecting to said water injection pipe of said sealed cavity; said major and said minor flushing control valves providing with respective inlets concurrently connecting to said water release pipe of said sealed cavity; said major and minor flushing control valves providing with respective outlets connecting to a water release hole via said linking pipe; said water release hole intercommunicating with said exterior of said sealed water tank.

2. The button-controlled pressure flushing device as claimed in claim 1, wherein, said flushing valve includes a valve body, a valve disc, and an upper cover; said valve body is formed by a circular valve base and a tubular member connected to a bottom of said valve base; a tube opening on a top of said valve body shapes a valve opening; said upper cover has a dimension suits to said valve base; said inner wall is formed like an inward arcuate; said valve disc is installed on said circular valve base; said upper cover engages with said circular valve base for clipping said valve disc there between, so that said sealed cavity would be formed between said upper surface and said inner wall of said upper cover; said upper surface of said upper cover has said water injection pipe and said water release pipe as tubular joints disposed thereon for being intercommunicated with an inner hole.

3. The button controlled pressure flushing device as claimed in claim 2, wherein, said valve disc adopts a circular platform with a thin brim formed on an upper periphery thereof; a diameter of said brim is consistent with a diameter of said valve base; a diameter of said circular platform is larger than a diameter of said valve opening; said circular platform further provides with a rigid circle embedded therein.

4. The button controlled pressure flushing device as claimed in claim 2 or 3, wherein, said air induce hole and said water release hole as tubular joints are respectively disposed on a tubular wall of said valve body of said flushing valve for being intercommunicated with said inner hole.

5. The button controlled pressure flushing device as claimed in claim 1, 2 or 3, wherein, said inlet channel adopts a taper shape; said air channel communicates with a convergence of said inlet channel and said outlet channel; said inlet channel hole of said air induce device communicates with an inlet pipe; said air channel communicates with exterior via a one-way air induce valve.

6. The button controlled pressure flushing device as claimed in claim 4, wherein, said inlet channel of said air induce device adopts a taper shape; said air channel intercommunicates with a convergence of said inlet channel and said outlet channel; an inlet channel hole of said air induce device communicates with said inlet pipe; said air channel communicates with exterior via a one-way air induce valve.

* * * * *